US008230711B2

(12) United States Patent
Klapdor et al.

(10) Patent No.: US 8,230,711 B2
(45) Date of Patent: Jul. 31, 2012

(54) ROLLING MILL FOR ROLLING METALLIC MATERIAL

(75) Inventors: Armin Klapdor, Kirchlundem (DE); Ralf Ohrndorf, Hilchenbach (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 1090 days.

(21) Appl. No.: 11/632,566

(22) PCT Filed: Jun. 21, 2005

(86) PCT No.: PCT/EP2005/006669

§ 371 (c)(1),
(2), (4) Date: Apr. 10, 2008

(87) PCT Pub. No.: WO2006/007919

PCT Pub. Date: Jan. 26, 2006

(65) Prior Publication Data

US 2008/0209970 A1 Sep. 4, 2008

(30) Foreign Application Priority Data

Jul. 15, 2004 (DE) ..... 10 2004 034 090

(51) Int. Cl.
*B21B 31/18* (2006.01)
*B21B 39/20* (2006.01)
*B65H 16/02* (2006.01)

(52) U.S. Cl. ..... 72/247; 72/250; 242/592

(58) Field of Classification Search ..... 72/203, 72/237, 247, 250, 251, 420, 421, 465.1, 466.7; 242/592, 591, 560.3, 560.2, 559, 533, 599.4
See application file for complete search history.

(56) References Cited

U.S. PATENT DOCUMENTS

| | | | | |
|---|---|---|---|---|
| 4,494,395 | A * | 1/1985 | Brettbacher et al. | 72/203 |
| 5,285,670 | A * | 2/1994 | Thomas | 72/203 |
| 5,362,340 | A | 11/1994 | Daly et al. | |
| 5,362,341 | A | 11/1994 | Palmer et al. | |
| 5,470,405 | A | 11/1995 | Wyatt-Mair et al. | |
| 5,495,736 | A | 3/1996 | Nishi et al. | |
| 6,237,205 | B1 | 5/2001 | Yoshimura et al. | |
| 2002/0062889 | A1 | 5/2002 | Finck et al. | |

FOREIGN PATENT DOCUMENTS

| | | | |
|---|---|---|---|
| JP | 61052901 | A | 3/1986 |
| JP | 03184618 | A * | 8/1991 |
| JP | 07054111 | | 2/1995 |

* cited by examiner

*Primary Examiner* — Teresa M Ekiert
(74) *Attorney, Agent, or Firm* — Andrew Wilford

(57) ABSTRACT

A rolling mill (1) for rolling a metal workpiece (2) that is provided with at least one roll stand (3) as well as with a conveyor (4) for the material to be rolled (2) extending on both sides of the roll stand (3) for a predetermined length (L) is based on the object that in the area of the longitudinal extent of the conveyor (4) at least one holder (5) for a coil (6) of the metal workpiece (2) is provided that can be positioned in a first position (A) in which it does not disturb the transport of the metal workpiece (2) along the conveyor (4) and that can be positioned in a second position (B) in which the coil (6) is positioned close to the roll stand (3) on the conveyor (4) for unwinding or winding up the coil (6).

7 Claims, 2 Drawing Sheets

ROLLING MILL FOR ROLLING METALLIC MATERIAL

CROSS REFERENCE TO RELATED APPLICATIONS

This application is the US national stage of PCT application PCT/EP2005/006669, filed 21 Jun. 2005, published 26 Jan. 2006 as WO 2006/007919, and claiming the priority of German patent application 102004034090.0 itself filed 15 Jul. 2004.

FIELD OF THE INVENTION

The invention relates to a rolling mill for rolling a metal blank and that has at least one roll stand as well as a conveyor for the material to be rolled extending on both sides of the roll stand over a predetermined length.

BACKGROUND OF THE INVENTION

Rolling mills of this type are for example required in the production of aluminum sheet. Here, the sheet is produced during a procedure including several steps where first the billet is hot rolled. Once the billet has been rolled out sufficiently and, optionally, has been thermally treated, a cold rolling of the sheet is done to obtain its final thickness. Hot-rolling mills as well as cold-rolling mills are commonly used for this purpose and described in a sufficient manner in the state of the art.

WO 98/53111 (US 2002/0062889) discloses a method for producing hot rolled aluminum strips for cans, the method being intended to be particularly suitable for smaller production runs of less than 250,000 t per year. First, a back- and forth prerolling of the raw material is done in a hot-rolling mill, followed directly by the final rolling of the strip and subsequently by a thermal treatment of the strip that is wound into coils. Here, during the last of the final reduction passes, recrystallization in the roll material is suppressed by a regulated temperature control of the hot strip and the recrystallization is intended and allowed to happen only directly after the final rolling outside the rolling train.

WO 96/10655 (U.S. Pat. No. 5,362,341) and WO 96/10656 also relate to a method of producing aluminum sheets. Also in this case, a hot rolling of the billet or of the strip produced by the rolling process on the hot-rolling mill is done first. Then, a thermal treatment process is carried out and finally, a cold-rolling procedure is done in a cold-rolling mill.

The hot-rolling mill and the cold-rolling mill are fundamentally different from each other since the hot-rolling mill requires a conveyor for the material to be rolled extending on both sides of the roll stand over a predetermined length. First, the billet is introduced into the rolling mill and rolled out. Here, there is typically a back-and-forth process, i.e. the billet that becomes thinner and thinner from being rolled rolling moves back and forth through the roll stand. Once the hot-rolling procedure has been completed, the strip that is rolled out is wound onto a spool in order to form a coil.

In cold rolling, however, the already prepared coil is inserted into the rolling mill. The roll stand is located between two spools. The strip is wound off the coil of the spool and directed towards the roll nip. On the other side, the cold-rolled strip is fed to the other spool and rewound into a coil.

Due to these facts, the proportions or the installation space required are substantially different for a hot-rolling mill on the one hand, and a cold-rolling mill on the other hand. The hot-rolling mill is quite long, whereas the cold-rolling mill is relatively short.

In view of the efficiency of existing rolling mills and thus with respect to the economic efficiency of the investments, it is disadvantageous that a separate rolling mill is required for each process. This is in particular true if the hot-rolling mill is not required during the cold-rolling procedure and vice versa.

OBJECT OF THE INVENTION

Thus, the invention is based on the object to design a rolling mill of the above mentioned type such that the mentioned disadvantage does not occur and that a more efficient use can be achieved.

SUMMARY OF THE INVENTION

This object is attained according to the invention in that in the area of the longitudinal extent of the transport path at least one holder for the coil of the metal workpiece is provided that can be moved into a first position in which it is not in the way of the transport of the metal workpiece along the conveyor and the holder can be moved to a second position in which it positions the coil close to the roll stand on the conveyor for unwinding or winding up the coil.

Thus, the invention has the object of taking measures in order create a hot-rolling mill that is also suited for cold-rolling processes. The holder for a coil that is not required for hot rolling can be positioned, for example, underneath the roller conveyor and is not used during hot rolling. For cold rolling, the holder is brought into the operating position such that cold rolling can also be carried out in the hot-rolling mill. Thus, the economic efficiency of the rolling mill is significantly increased.

According to one embodiment, it is intended that at least one holder be mounted on a lifter by means of which it can be vertically positioned at the intended height. This way, it may be in particular intended that at least one strip-guiding roller, in particular a driven strip-guiding roller, is mounted on the lifter. The roller is required for the cold-rolling procedure since the strip to be rolled has to be deflected from the spool to the horizontal before the strip is directed toward the roll nip. Here, it is particularly advantageous if at least one strip-guiding roller is positioned in the lower position of the lifter at the height of the other rollers of the conveyor. Thus, it fulfills a function even during the hot-rolling procedure.

In an advantageous manner, a pair of hot edge-trimming shears are provided that have actuators, in particular vertical actuators, by means of which they can be brought into (for the hot-rolling procedure) or out of the operating position (for the cold-rolling procedure).

Furthermore, strip supporting and/or strip driving and/or strip adjusting means, which are provided with actuators, in particular with vertical actuators, by means of which they can be brought into (for the cold-rolling procedure) or out of the operating position (for the hot-rolling procedure), are advantageous for the cold-rolling procedure. The strip supporting and/or strip-advancing and/or strip-adjusting means are preferably an already known bridle-roller-assembly, in particular a four-roller bridle-roller-assembly with its own drive.

Furthermore, at least one counter roller interacting with the strip-guiding roller and that can be displaced vertically and positioned at a predetermined height is provided.

Since different rolls are required for, on the one hand, the hot-rolling procedure, and, on the other hand, the cold-rolling procedure, means for replacing the rolls of the roll stand by means of which the replacement of the rolls can be done or at least aided are preferably provided.

Finally, both types of rolls require different cooling or lubrication conditions. In order to use the rolling mill for both rolling processes, one improvement provides that the rolling mill is provided with means for providing a coolant and/or a lubricant to the rolls of the roll stand and/or the material to be rolled, the means being optionally used for the supply with rolling oil or emulsion.

BRIEF DESCRIPTION OF THE DRAWING

The drawing illustrates an illustrated embodiment of the invention. Therein.

DETAILED DESCRIPTION

Figure 1:
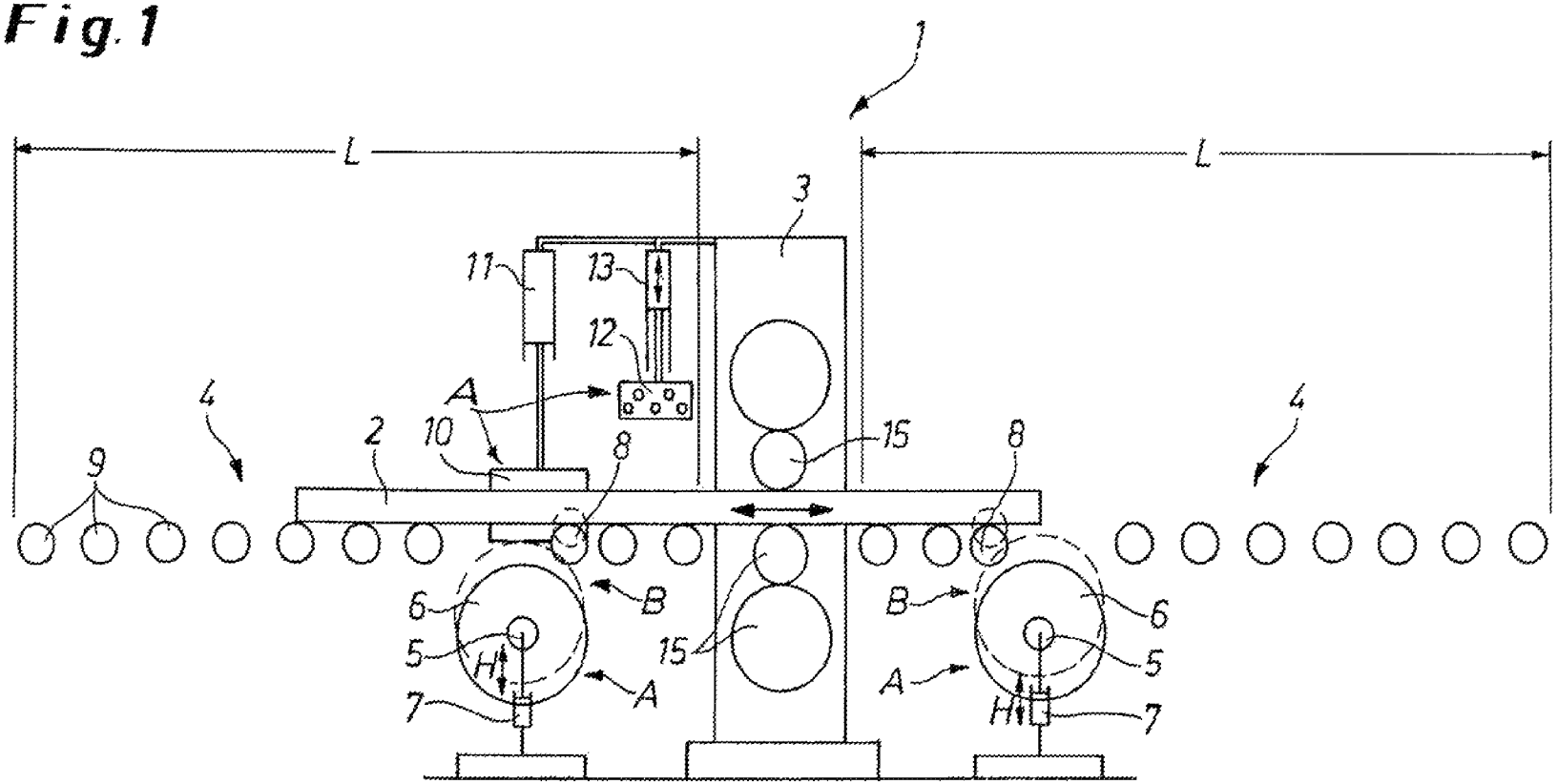
FIG. 1 shows a schematic view of a rolling mill during the hot rolling of an aluminum billet and FIG. 2 shows the rolling mill according to FIG. 1 during the cold rolling of aluminum strip.

The figures show a portion of a rolling mill 1 in which both a cold-rolling process and a hot-rolling process can be optionally done. The rolling mill serves for rolling a metal workpiece 2 that is shown as a billet in FIG. 1 and as a prerolled sheet in FIG. 2. A roll stand 3 that is here embodied as a four-high roll stand with two working rolls and two backing rolls serves for rolling. Here, the rolls for hot rolling are shown at 15 (see FIG. 1) and the ones for cold rolling are shown at 16 (see FIG. 2). However, one or more other roll stands can also be used. On both sides of the roll stand 3, on the left and on the right side of the roll stand in the figures, extends a conveyor 4 with a predetermined length L. The lengths L are equal on both sides of the roll stand 3, but not necessarily so. A number of support rollers 9 are provided in a known manner along the conveyor 4.

The hot-rolling process is done by means of the arrangement of the rolling mill 1 shown in FIG. 1. Thus, the billet 2 moves back and forth through the roll stand 3 (see the horizontal double-arrow). Every reduction pass further reduces the thickness of the billet until a thickness needed for hot rolling is obtained.

Underneath the conveyor 4, i.e. underneath the roller conveyor and on both sides of the roll stand 3, there is a holder 5 for a coil of rolled strip. An actuator or lifter 7 as well as a double arrow inserted vertically are shown only schematically. The stroke H that is also shown indicates that the lifter 7 can vertically lift or lower the holder 5 including the coil 6. Here as well as in the following embodiments, a piston-cylinder-system is shown schematically as the actuator 7, it being indicated that the movement can be done hydraulically. However, it is also possible that the movement can be effected by means of an electrical actuator or the like.

During the hot-rolling procedure according to FIG. 1, the holder 5 shown in solid lines is in a lower position; dashed lines indicate the upper position of the holder 5 and the coil 6 during the cold-rolling procedure. The hot-rolling position is shown at A (first position) whereas the cold-rolling position is shown at B (second position).

Furthermore, a strip-guiding roller 8 is mounted on the lifter 7 that is shown only very schematically. When the holder 5 for the coil 6 is shifted vertically, the roller 8 is also moved upward or downward. Here, the rolling mill is designed such that the strip-guiding roller 8 is located exactly at the height of the other rollers 9 of the conveyor 4 when it is in its lower position, i.e. in the position it serves for the back-and-forth movement of the billet 2. The strip-guiding roller 8 in FIG. 1 is also shown by solid lines in the position A that is used during the hot-rolling procedure, whereas the position B that is used during the cold-rolling procedure is shown by dashed lines.

Normally, for the hot-rolling procedure a pair of hot edge-trimming shears 10 is required that is mounted on an actuator 11 by means of which they can be moved vertically and brought into their respective lower and upper positions A and B. In this case, too, the position A refers to the position during the hot-rolling procedure and position B to the one during the cold-rolling procedure. As can be seen when both FIGS. 1 and 2 are considered, the one pair of edge-trimming shears 10 in FIG. 1 has taken its operating position during hot rolling whereas it is disengaged during the cold rolling.

The strip-supporting and/or strip-driving and/or strip-adjusting means that are shown at 12 are not required for the cold-rolling procedure. In particular, they represent a bridle-roller-assembly with an attached drive. In FIG. 1, therefore during the hot-rolling procedure, the means 12 are not in their operating position, but in a raised position that they are put in by the actuators 13. Accordingly, during the cold-rolling procedure, see FIG. 2, the means 12 are brought into their operating position by the actuators 13.

Figure 2:
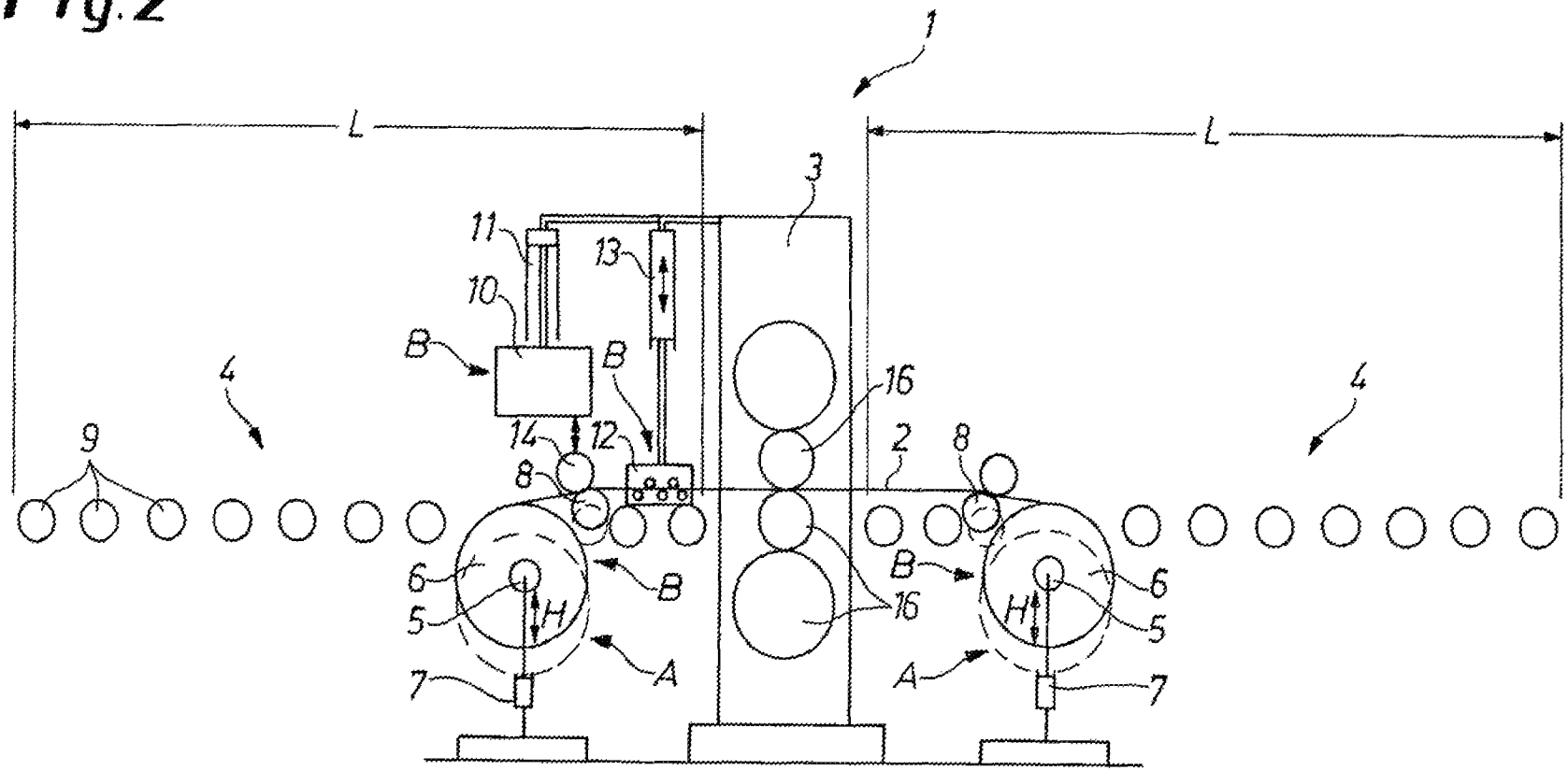

In FIG. 2 a schematically displayed counter roller 14 can be seen that is required for the cold-rolling procedure and that can be brought into its operating position by movement means that are not shown. The counter roller 14 interacts with the strip-guiding roller 8 and ensures the guidance and optionally the driving of the strip 2 to be cold-rolled.

Within a short period (a few hours), the described rolling mill can be reconfigured such that it is suitable for hot or cold rolling. Thus, the economic efficiency of the rolling mill is significantly increased in the case, i.e. in the event that one roll type is not used to full capacity.

Although a large number of further elements is not shown, they are done in the manner commonly used for hot or cold-rolling mills. As far as new elements or components are mentioned in the following, they are to be understood as such elements or components that have to be newly integrated into the hot-rolling mill in order to render it suitable for the cold-rolling procedure.

A station for preparing the coils to be cold-rolled can have a lifter, a coil unwinder, a coil opening table, a driving-roller unit and an adjusting-drive unit, a pair of trimming shears, a basic frame with a scrap slide, a scrap bucket including a positioning unit, a coil tong as well as a coil-centering and a height-adjusting unit.

The output-side spool is provided with a strip centerer, a displacing frame for the unwinding equipment, a drive shaft and a thrust bearing for displacing the spool and an external spool bearing.

In the area of the inlet side of the strip to be rolled are mounted a pressing roller at the roller conveyor, a chisel for opening the coil, a brushing device for a deflecting roller, a bearing housing for the deflecting roller including an arrangement of load cells, a post roller including a brushing device, a hold-down roller, a pair of trimming shears with scrap evacuation and the bridle-roller arrangement including its drive.

In the area of the central roll stand are the rolls with the displacing and bending system, a spindle holder, driving spindles (cardan shafts) with longitudinal compensation and contact points on the sides of the motor and the rolls, a spindle balancing with the bearings for the spindle, thrust bearings for the working rolls, optionally a changing frame for the working rolls, cardan shafts for the working roll brushes, a backing roll interlocking, working roll chocks, stripping edges, a strip blowing-off device, a strip edges blowing-off device, an outgoing guidance, a device for the distribution of cooling medium, a backing roll stripper and a brushing device for the backing rolls.

A drive stand as well as a post roller including a brushing device, a flatness-measuring roller with protection beam and load cells and a brushing device for the flatness-measuring roller are located in the area of the outgoing side.

Furthermore, a belt wrapper including a coil tong, a conveyor table for the belt wrapper and a vapor evacuation channel are provided.

For handling of the coil a distance-measuring system for positioning the workpiece, a distance-measuring system for positioning the coil, a distance-measuring system for the holding-down rollers of the coil tong and a distance-measuring system for the coil tong are provided.

These systems are, as already mentioned, optionally adapted to the optional arrangement as hot-rolling mill or as cold-rolling mill. In other respects, the systems are designed as known in the art. This concerns the hydraulics and pneumatics (hydraulic or pneumatic controls, machine tubing), the rolling oil pipework in the area of the roll stand, the emulsion pipework in the area of the roll stand, the oil-air-lubrication (control of the oil-air-lubrication, machine pipework), the central grease lubrication (machine pipework), the connecting tubes and the rolling oil arrangement (rolling oil and emulsion).

Concerning the proceeding and operating modes or the retooling of an existing aluminum hot reversing rolling mill such that a rolling mill for combined hot- and cold-rolling procedures is done, the following should be noted:

The inlet coils are loaded by means of the rolling mill itself into a pivotable roller lifter in order to be moved to the coil preparation station. The roller lifter can be driven out from underneath the support frame of the coil tong in order to receive the coils. The coils are brought into the coil-preparation position by the roller lifter and are threaded on the roller preparation station for preparation purposes. In the coil preparation station, which consists of coil-opening tables, a driven roller-adjusting unit, a pair of trimming shears and a scrap bucket positioning device, the leading end of the strip or the outer loops of the coils are cut.

After the preparation procedure, the coils are turned into the correct preceding position by means of a pivotable roller lifter; and depending on the coil diameter, they are positioned in accordance to the height, i.e. at the spool height.

Subsequently, the coils are transferred to the existing coil tong and are applied on the other spool on a signal of the coil centering and of the distance-measuring system mounted on the coil tong.

In order to allow for the coil preparation station to be approached by the coil tong, the supporting frame is extended toward the coil tong.

The spool 5 is provided with the lifter 7 and corresponding driving shafts, thrust bearings and coil middle regulations.

Once the coil has been wound on the spool, the pressing roller (strip driving roller 8) that can be pivoted in from below is applied to the coil. The coil tong is opened and moved out of the rolling line. Then, the second pressing roller (counter roller 14) can be applied on the coil. A coil-opening chisel that is mounted on the existing supporting frame of the driving aggregate or of the adjusting roller aggregate is moved toward the coil to guide the beginning of the strip. In the lower position, the two pressing rollers, as described above, form part of the roller conveyor for the hot operation mode.

The beginning of the strip is pushed forward to the drive by turning the spool and the driven pressing rollers. There, the beginning of the strip is put over the cold driving roller, the post roller and the holding-down roller. Cleaning devices for the cold driving roller and the post roller are provided. The upper driving roller bearing is provided with load cells for measuring strip tension. The beginning of the strip is guided over a pair of trimming shears toward the bridle-roller-assembly with driven rollers and the following drive. The combination of trimming shears, bridle-rollers and drive on one common movable basic frame can be moved out of or into the rolling line by means of the existing positioning device of the one pair of hot edge-trimming shears. The basic frame is provided with an oil drip pan that receives and drains off the roll oil for the lubrication of the bridle-rollers or of the bridle-roller bearing.

Due to the impact on the profile or on the flatness, the central area of the stand is provided with a known roll displacing mechanism. Thus, new driving spindles with spindle balancing as well as a new spindle clamping are required besides the modifications and the new components for the set of rolls.

Distribution of the cooling medium is done by means of the existing spray bars that, however, are provided with new nozzles.

A separate set of rolls that does not contain roll brushes but that is provided with a separate blowing-off device for the rolls is required for the cold-rolling reduction passes. A further strip blowing-off device is mounted in the inlet guides to be rebuilt (water boxes).

The drive is designed according to the existing drive as far as its construction is concerned, but it is also provided with a flatness-measuring roller and a corresponding cleaning device. During hot operation, the flatness-measuring roller is protected by a beam that can be pivoted in. A new cylindrical post roller with a cleaning device is provided. The hydraulic cylinder for adjusting the flatness-measuring roller is provided with prop connectors for safe positioning. The bearing reception of the flatness-measuring roller is provided with load cells for measuring the strip tension.

In the area of the device for measuring the existing strip thickness, there are mechanical fasteners for the insertion of strip scanners that serve for detection of the positions of the strip edges.

The strip coming out of the output device is guided toward the cold-strip winder mounted on the existing supporting frame facing toward the hot belt winder or the coil tong by means of a conveyor table that can be hydraulically raised and lowered. The supporting frame is modified for the insertion of the new cold belt wrapper.

The supply of the spools is done by the existing coil tong. The spools are lain on the lifter by means of the rolling mill itself. The lifter is driven into a defined height position in which the spools are transferred to the existing coil tong and fitted to the spool mandrel by means of the spool centerer. Removal of the spools on the inlet side is also done by the coil tong there. Here, the spools are set on the existing lifter and transferred to the existing bump chain conveyor. Removal of the spools from the bump chain conveyor is done with the help of the rolling mill itself. In both spool tongs, a pressing roller is provided with a distance-measuring system.

The reconfiguring from the hot-rolling operation mode to the cold-rolling operation mode is done as followed:

First, the set of rolls for hot rolling is moved out. Then, the roll stand is cleaned manually by means of a steam jet cleaning. Subsequently, the set of cold-rolling mills is moved in. Furthermore, the four-roller-bridle assembly with the attached drive is moved into the rolling mill. Insertion is done by moving the one pair of hot edge-trimming shears out of the rolling line.

On the other hand, the measures for changing from the cold-rolling operation mode to the hot-rolling operation mode are as followed:

First, the set of rolls for the cold-rolling procedure is moved out. Then, the working rolls for the hot-rolling procedure are moved in. Subsequently, the four-roller-bridle assembly with the attached drive is moved out of the rolling mill. This step is completed by moving the one pair of hot edge-trimming shears into the rolling line.

Furthermore, as already mentioned before, measures for the alternating operation mode as far as the supply with emulsion or rolling oil is concerned are taken. The branch in the existing return line for roll oil operation mode is provided with cutoff valves that can be adjusted manually. The residue is evacuated into the pump well. A flame trap is inserted into the return pipe leading toward the oil return pump vessel. A new oil return pump vessel is provided with a separate chamber for flushing oil. Furthermore the required return pumps and return pump lines leading toward the roll oil arrangement are provided. New roll oil supply lines with deflection valves are connected as close as possible to the existing grip beam. A connection for blowing out the grip beams by means of compressed air is provided. Finally, also a connection for flushing the spray bar as well as the sump by means of roll oil is provided.

The operation mode when switching from the emulsion operation mode into the roll oil operation mode is as followed:

First, a manual cleaning of the stand is done by a steam jet cleaning device. During this operation, the emulsion is directed toward the return pump vessel. Then, the grip beam is blown out by means of compressed air. Subsequently, the vessel is emptied until the minimal level is reached by means of the return pump or the evacuation pump. The valves in the return line for the emulsion are closed after a corresponding drip time. Then the discharge channel into the new reception chamber for used flushing oil is opened. Once the system pump of the rolling oil arrangement has been started, the injector bar and optionally also the sump are rinsed with roll oil by means of a flushing connection. Polluted wash oil is evacuated over the reception chamber toward the vessel for used flushing oil in the new roll oil plant by means of return pumps. Finally, the return line leading toward the return pump vessel for roll oil is opened.

The operation mode when switching from the roll oil operation mode into the emulsion operation mode is done as followed:

First, the grip beam is blown out by compressed air. Then, the return line leading toward the return pump vessel for roll oil is closed after a corresponding dripping period. Subsequently, the evacuation connection on the return for rolling oil is opened. Once the evacuation connection on the return for rolling oil has been closed, the return line leading toward the return pump vessel for emulsion is opened.

The deflection fittings in the return lines as well as the return lines are designed as manual fittings with control of their final positions. The deflection fittings in the supply lines on the stand are designed as pneumatically actuated fittings with control of the final position.

The required modifications of the hydraulic or on the pneumatic control as well as the corresponding modifications of pumps, compressors and corresponding aggregate pipework are not further specified and done in the usual expert manner.

The required modifications can be done in a comparatively cost-efficient way as far as the instrumental equipment and the measures to be taken are concerned such that the proposal according to the invention leads to a large economic efficiency.

The invention claimed is:

1. In a rolling mill for rolling a metal workpiece and provided with at least one roll stand and with a conveyor for the workpiece to be rolled and extending longitudinally on both sides of the roll stand over a predetermined length, the improvement comprising:

a holder for a coil of the metal workpiece that can move transversely of the conveyor between a lower first position in which it does not disturb longitudinal transport of the metal workpiece along the conveyor and an upper second position in which the coil is positioned close to the roll stand on the conveyor for unwinding or winding up of the coil;

a lifter for carrying the holder and for vertically moving the holder between the upper and lower positions; and a driven strip-guiding roller mounted on the lifter.

2. The rolling mill according to claim 1, wherein the strip-guiding roller is positioned in the lower position of the lifter at the height of other rollers of the conveyor.

3. The rolling mill according to claim 1, further comprising one pair of hot edge-trimming shears provided with vertical actuators with which they can be brought into an operating position or out of this operating position.

4. The rolling mill according to claim 1, further comprising strip supporting or driving or adjusting means provided with vertical actuators by means of which they can be brought into an operating position or out of the operating position.

5. The rolling mill according to claim 4 wherein the strip supporting or driving or adjusting means are provided with a bridle-roller-assembly with an attached drive.

6. The rolling mill according to claim 1, further comprising a counter roller that interacts with the strip-guiding roller that can be vertically positioned at a predetermined height.

7. The rolling mill according to claim 1, further comprising means for providing coolants or lubricants to rolls of the roll stand or to the workpiece to be rolled.

* * * * *